US005791802A

United States Patent [19]

Englum

[11] Patent Number: 5,791,802

[45] Date of Patent: Aug. 11, 1998

[54] MENU BOOKLET

[76] Inventor: Bernard J. Englum, 1474 S. State Rd. 3, Hartford City, Ind. 47348

[21] Appl. No.: 796,030

[22] Filed: Feb. 5, 1997

[51] Int. Cl.[6] ..... B42F 3/06

[52] U.S. Cl. ..... 402/57

[58] Field of Search ..... 281/29, 21.1, 51, 281/28; 402/57; 72/46, 47; 428/364, 368, 369, 371, 375, 380; 412/39

[56] References Cited

U.S. PATENT DOCUMENTS

| | | | |
|---|---|---|---|
| 4,606,554 | 8/1986 | Lederman | 280/51 |
| 4,907,905 | 3/1990 | Fournier | 402/57 X |
| 5,407,232 | 4/1995 | DesJarlais | 405/57 X |
| 5,417,508 | 5/1995 | Friedman | 402/51 X |

*Primary Examiner*—Willmon Fridie, Jr.

*Attorney, Agent, or Firm*—Daniel J. O'Connor

[57] ABSTRACT

A bookbinding system for use in combination with a restaurant menu. The structure allows restaurant menus to be utilized in a high-volume environment and extends the useful life of such menus

1 Claim, 1 Drawing Sheet

MENU BOOKLET

BACKGROUND AND OBJECTS OF THE INVENTION

The present invention is related to the bookbinding arts and, in particular, to a novel method and design for binding high-use books and booklets such as menus.

Prior art designs in related technology typically involve relatively low-volume use booklets such as school notebooks or albums. Because of such low-volume use, such booklets can be fabricated of less sturdy materials.

In contrast, in the high-volume use required for restaurant menus, a more sturdy and long-life fabrication has been found to be advantageous.

Restaurant owners specifically require a long-life and high quality menu which does not need to be frequently replaced and which is attractive to restaurant patrons.

Accordingly, it is an object of the present invention to demonstrate a novel restaurant menu structure which may be economically manufactured and sold.

It is a further object of the invention to set forth a menu design which has enhanced durability and a longer life.

It is a further object of the invention to show a novel menu construction which has a high-quality appearance for customer appeal.

These and other objects and advantages of the present invention will be apparent to those of skill in the art from the description which follows.

PRIOR ART PATENTS AND DESIGNS

During the course of preparing this application for submission to the U.S. Patent and Trademark Office, a full search of the prior art was conducted.

The most relevant patents found are listed as follows:

U.S. Pat. No. 3,956,798 which teaches a flexible binding. Such would not be suitable for the menu arts recited herein by reason of its lack of strength and the complex assembly required.

U.S. Pat. No. 4,519,629 shows the general state of the art for a spiral binding intended to be used with tearable paper. In contrast, the present invention provides an enhanced spiral design in combination with plastic menus not intended to be torn.

SUMMARY OF THE INVENTION

The present invention provides an improved spiral design with a softer coated outer surface while retaining overall required strength.

The design is used in combination with menu booklets having plastic components. Such menus have a very high-volume usage as is required in the restaurant arts.

DESCRIPTION OF THE PREFERRED EMBODIMENT

Figure 1:
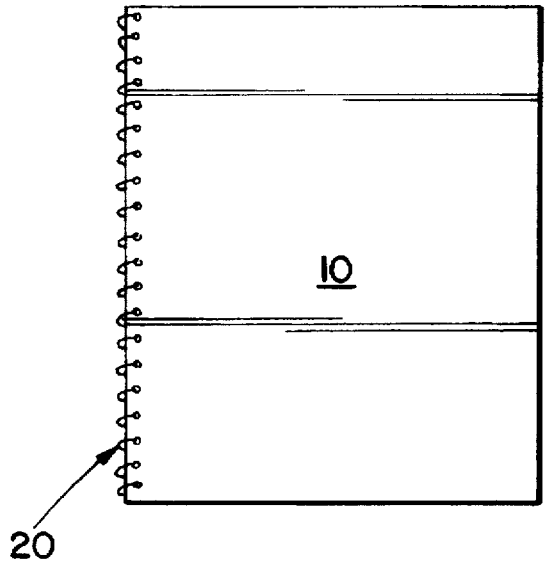
FIG. 1 shows an overall top view of a spiral-bound menu and menu cover.
Figure 2:
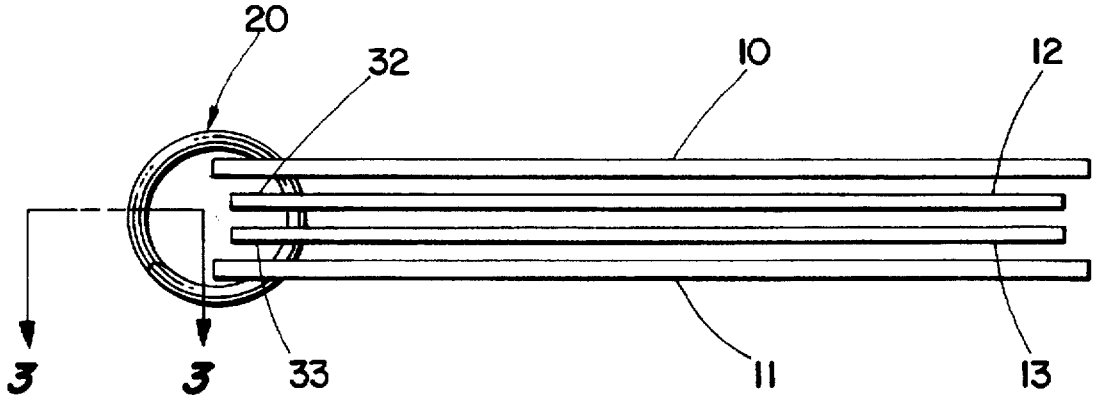
FIG. 2 shows an end view of the menu of FIG. 1 and illustrates the primary components of the invention.
Figure 3:
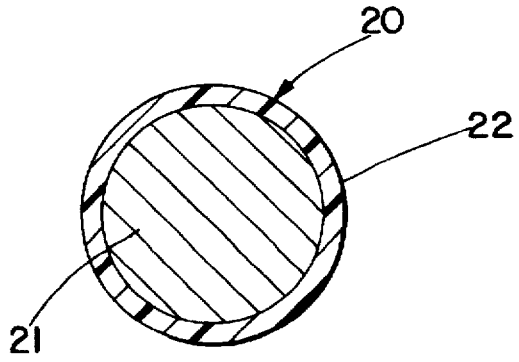
FIG. 3 shows a cross-sectional view of the spiral binding wire utilized and illustrates the coating applied thereto. This cross-sectional view is along lines 3—3 of FIG. 2.

Referring now to the Drawing FIGS. 1–3, FIG. 1 shows a front menu cover 10 and a spiral binding element 20.

The end view of FIG. 2 also shows front cover 10 and the spiral binding element 20. FIG. 2 further shows a rear cover 11 and intermediate page elements 12 and 13. Covers 10 and 11 would be fabricated of plastic or other high-quality covering materials. The intermediate pages 12 and 13 are normally comprised of plastic with space therein for paper menus to be inserted as is generally indicated in FIG. 2.

The left-side ends of pages 12 and 13 are indicated as numerals 32 and 33 in FIG. 2. These left ends 32 and 33 are also made of plastic and have apertures formed therein so that they may be bound by the binding element 20.

The elements 10–13 would normally be bound by a plain spiral wire 20. However, it has been discovered by the inventor herein that the life and quality of the menu can be improved if a coating is added to the wire binding element 20. Such coating apparently has the effect of reducing the frictional wear between the elements 10–13 and the binding wire element 20.

Therefore, in accordance with the invention, FIG. 3 shows a cross-section of the binding wire element 20.

The binding element 20 has a normal inner portion 21 and a novel outer coating portion 22 formed thereon. The outer coating portion 22 may be plastic or an annealed material which gives the outer surface of wire 20 a softer contact with the bound elements 10–13. Such results in less wear and tear on the bound elements 10–13 and hence a longer life for the overall menu. The softer outer edge of wire 20 also renders the bound elements 10–13 easier to turn thus resulting in a higher overall quality menu.

The softer outer surface 22 of wire 20 being formed of plastic or annealed materials may be added by any of numerous manufacturing processes known in the arts.

From the above description, it will be appreciated that a novel menu booklet structure has been set forth which will extend the life and quality of menus and thus have widespread commercial appeal in the restaurant arts.

While a particular embodiment has been described and shown, it is intended to also cover all equivalent structures, materials and uses which would reasonably occur to those of skill in the art.

It is noted that the annealed coating referred to is generally defined in the metal arts as the softening of a metal via a heating and cooling process. Such process has not apparently been utilized in the binding arts or, specifically, in combination with a plastic menu booklet recited in the claims hereinafter.

I claim:

1. The combination of a restaurant menu used in high-volume, high-quality environments and a binding system therefor including, a front cover (10) for said restaurant menu, a rear cover (11) for said restaurant menu, a plurality of intermediate pages (12, 13) placed between said front and rear covers, a spiral wire means (20) for binding said front and rear covers and said intermediate pages, said spiral wire means including a coating (22) thereon to provide means whereby said covers and said intermediate pages are less subject to damage in a high-volume use restaurant environment, said coating means (22) being comprised of a plastic or annealed composition to provide a softer outer edge for wire (20) thus rendering the bound elements easier to turn, said intermediate pages (12, 13) being comprised of continuous plastic material with space therein for paper menus to be inserted.

* * * * *